US005373721A

United States Patent [19]

Welsh et al.

[11] Patent Number: 5,373,721

[45] Date of Patent: Dec. 20, 1994

[54] METHOD AND APPARATUS FOR SCORING METAL PANELS AND RESULTANT PRODUCT

[75] Inventors: Robert E. Welsh, Mt. Lebanon; Ernest J. Clowes, Lower Burrell, both of Pa.

[73] Assignee: Aluminum Company of America, Pittsburgh, Pa.

[21] Appl. No.: 14,374

[22] Filed: Feb. 5, 1993

[51] Int. Cl.[5] ..... B21D 28/10

[52] U.S. Cl. ..... 72/377; 72/412; 413/12; 413/55

[58] Field of Search ..... 72/324, 325, 377, 379.2, 72/412, 472; 413/12-15, 17, 55, 67

[56] References Cited

U.S. PATENT DOCUMENTS

| | | | |
|---|---|---|---|
| 2,760,263 | 8/1956 | Geertsen | 72/377 |
| 3,563,199 | 2/1971 | Wolfe | 413/12 |
| 3,815,534 | 6/1974 | Kneusel | 413/12 |
| 3,820,681 | 6/1974 | Hulse | 413/12 |
| 4,122,791 | 10/1978 | Brown | 413/12 |
| 4,348,464 | 9/1982 | Khourt | 413/17 |

FOREIGN PATENT DOCUMENTS

| | | | |
|---|---|---|---|
| 156528 | 9/1984 | Japan | 413/17 |
| 289933 | 12/1986 | Japan | 413/55 |

*Primary Examiner*—Daniel C. Crane

*Attorney, Agent, or Firm*—Arnold B. Silverman; David W. Brownlee

[57] ABSTRACT

A method of scoring a metal panel such as a can end lid includes forming a first scoreline having a base and a pair of lateral walls and subsequently forming a second scoreline within the first scoreline by indenting a portion of the first scoreline base. The final scoreline may be created by employing two or more scoring operations after the first scoreline has been formed. The apparatus preferably includes a press which supports the first scoring die and second scoring die in such a manner as to establish the desired sequence of scoring operations. This method and associated apparatus provide a scored metal panel or container lid having improved performance characteristics. The resultant lid is characterized by reduced residual strain.

15 Claims, 6 Drawing Sheets

METHOD AND APPARATUS FOR SCORING METAL PANELS AND RESULTANT PRODUCT

BACKGROUND OF THE INVENTION

1. Field of the Invention

The present invention relates to a method of creating a scored metal panel such as a metal container lid through sequential scoring operations which provide improved performance properties for the container lid and it also relates to associated apparatus for effecting such scoring and the scored lid.

2. Description of the Prior Art

It has been known for many years that metal panels may be provided with thinned zones in order to facilitate subsequent fracture of such zones. A particular known application is in connection with containers which have embodied what has been called "an easy open end." For example, it has been known to provide thinned zones which define regions that may be totally or partially removed in order to permit access to the contents of beverage and food cans. See, generally, U.S. Pat. Nos. 3,650,006; 3,701,330; 3,728,980 and 3,946,683.

It has been known to provide a single indenter tool having a trapezoidal profile which has a generally flat base with a pair of upwardly diverging straight sidewalls in order to thin the metal panel within a predetermined region which is adapted to be totally or partially removed in opening a container. It has also been known to secure various types of lever tabs to such scored zones so as to provide a mechanical advantage to the user in effecting fracture and opening of such containers. Typically, an organic coating is provided on the interior of such a container lid so as to resist undesired corrosive attack of the container lid material by the contents of the container.

As is apparent, in designing such container walls it is desired to achieve an optimum balance between sufficient depth of scoreline to facilitate ease of opening by the consumer, while having adequate residual metal in the scoreline so as to preserve the required strength of the container lid during double seaming to the container, processing, storing, shipping, handling and ultimate use by the consumer. Such need is acute where the contents consist of a pressurized beverage such as a soft drink or beer and in food cans which may be vacuum packed or not.

In conventional scoring processes the scoring action produces an undesirable localized shear strain and residual strain in and adjacent to the scoreline. These regions are prone to undesired cracking and provide a preferential corrosion path. Even if an initial crack does not occur during sealing, a typical container is subjected to repeated cycles of applied force during processing, shipment, handling and storage. This repeated loading can result in metal fatigue that creates undesired cracking and leakage in the zone of increased strain created by the scoring operation.

The problem is acute with respect to alloys which tend to develop zones of high localized shear straining in this type of application, such as the 5 xxx aluminum alloys, for example, such as 5042 and 5182 and other high strength alloys which otherwise would be highly advantageous in such applications. Such high strength alloys, however, have limited formability as a result of their high strength and can provide highly localized shear strain distribution as a result of present scoring processes.

Also, a further problem resulting from shear strain is the fact that not only may partial destruction of the underlying organic protective coating result in corrosion, but also in the highly strained bands, the metal is more vulnerable to corrosion.

In addition to the hereinbefore described trapezoidal type profile for a scoring tool, a number of other configurations have been suggested. For example, U.S. Pat. Nos. 3,650,006 and 3,701,330 seek to provide improved abuse and fatigue resistance by eliminating the dead zone of compressed work-hardened metal underlying conventional scorelines. The disclosure suggests the use of a score tool having a predetermined included angle between lateral faces of the indenter tool which preferably is said to be about 80 to 100 degrees.

U.S. Pat. No. 3,728,980 discloses a scoring tool having a five-sided profile with a narrow tool base.

U.S. Pat. No. 3,954,075 discloses a scoring tool that provides a pair of anti-fracture scorelines laterally spaced from and of lesser depth than the principal scoreline.

U.S. Pat. No. 4,487,539 discloses effecting scoring from both sides of the metal material.

U.S. Pat. Nos. 3,898,944 and 4,012,935 disclose tools having a narrow scoring portion which first engages the metal followed by a broader based indenter tool surface.

U.S. Pat. No. 4,348,464 discloses a combination of scoring tools which have a stepped scoring tool cooperating with an underlying anvil having a pair of spaced scoring rims.

U.S. Pat. No. 3,359,773 discloses a scoring tool having a central depending indentor and a pair of laterally spaced bending elements. The underlying anvil has an upwardly projecting rib which is adapted to engage the metal in generally aligned relationship with the central scoring portion.

U.S. Pat. No. 3,946,683 relates to a table weakened wall container which wall has a plurality of weakened portions.

In spite of the foregoing known systems and products, there remains a real and substantial need for a method and associated apparatus for scoring a metal panel such as a metal container lid which will provide increased resistance to failure while maintaining improved opening characteristics.

SUMMARY OF THE INVENTION

The present invention has met the above-described need by providing a method of scoring a metal panel, such as a container lid, by establishing a first scoreline having a base and a pair of lateral walls and subsequently forming within the base of said first scoreline a second scoreline. By effecting scoring in this manner, the undesired consequences of conventional scoring in terms of establishing bands of strain which are vulnerable to both undesired fracture during handling, use and storage, and corrosion are minimized or avoided The scoring technique of the present invention also resists undesired fracture or undue thinning of the underlying organic coating material.

The method of the present invention may employ sequential scoring beyond the second scoreline through indenter tools which successively have an indenter face of reduced width with respect to the next proceeding indenter tool.

The apparatus of the present invention employs press means, which may be of a conventional variety, which have at least first and second scoring tool means for sequentially establishing scorelines with each successive scoring tool means having an indenter face of lesser width than the width of the indenter face of preceding scoring tools.

The scored container lid of the present invention has improved strain distribution while maintaining desired opening characteristics.

It is an object of the present invention to provide a scored metal panel which resists undesired cracking due to localized regions of strain established during the scoring operation.

It is the further object of the invention to provide a system for scoring metal container lid components without undesired cracking of the metal or destruction of the underlying organic coating material. It is a further object of the present invention to provide such scoring without requiring either repair coating or scoring of the underside of the containers.

It is another object of the present invention to provide such a system which will produce metal easy open ends which may be opened with improved ease.

It is another object of the present invention to provide a score of a depth not readily achievable in a single scoring step in a metal container lid.

It is another object of the present invention to facilitate the scoring of thinner gauge metal.

It is a further object of the present invention to provide such a system which will prolong tool life of scoring tools by performing two lower force scoring operations instead of one higher force scoring operation.

It is a further object of the present invention to provide such a system which will permit the production of more economical easy open ends as a result of the use of less metal.

It is yet another object of the present invention to provide such a system which will produce easy open ends made from metals which tend to localize strain in scoring operations.

It is a further object of the present invention to provide such a system for producing easy open ends which, through sequential scoring techniques, will serve to distribute strain in such a manner as to resist undesired damage due to the presence of shear bands.

These and other objects of the invention will be more fully understood from the following description of the invention with reference to the drawings appended hereto.

BRIEF DESCRIPTION OF THE DRAWINGS

FIG. 3(*b*) is a photomicrograph of a cross-section of a scoreline subjected to first and second scoring operations of the present invention.

DESCRIPTION OF THE PREFERRED EMBODIMENTS

As used herein, the expression "totally or partially removed" shall mean severance of scorelines to permit access to a container's contents either by complete separation of a portion of the container lid from the rest of the lid or merely creation of an opening therein without complete separation. The term will expressly embrace, but not be limited to both food and beverage type container lids.

Figure 1:
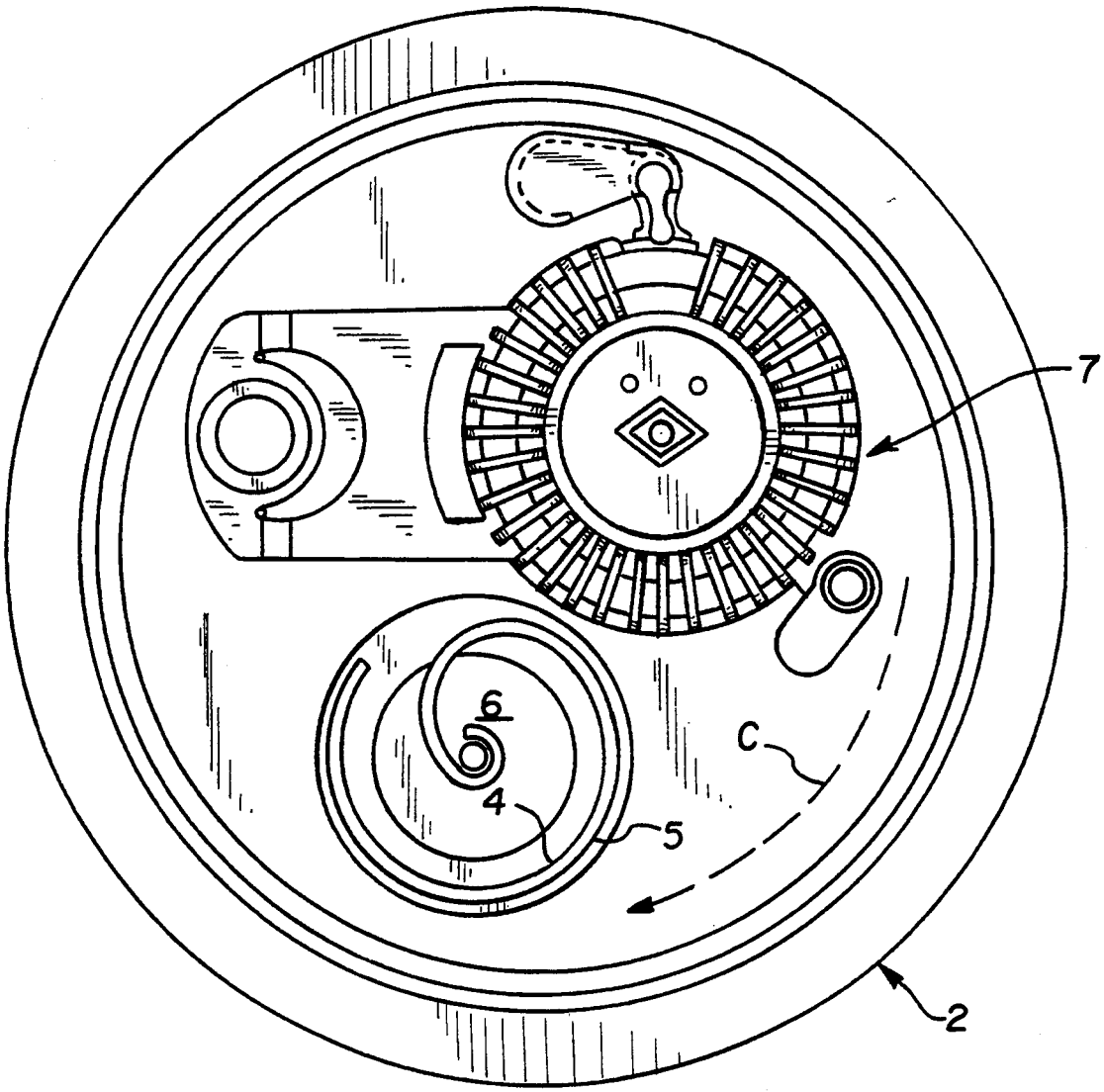
FIG. 1 is top plan view of an example of an easy open container lid having a reclosure.

Referring to FIG. 1 there is shown in plan a known beverage container lid 2 having a pair of scorelines 4, 5 defining a displaceable section 6. Fracture of scorelines 4, 5 may be effected by rotating reclosure 7 in the direction indicated by arrow C into overlying contact with section 6 and applying a downward force which will produce downward displacement of section 6. This partial separation of section 6 followed by reverse rotation of reclosure 7 will permit access to the container contents.

Figure 2:
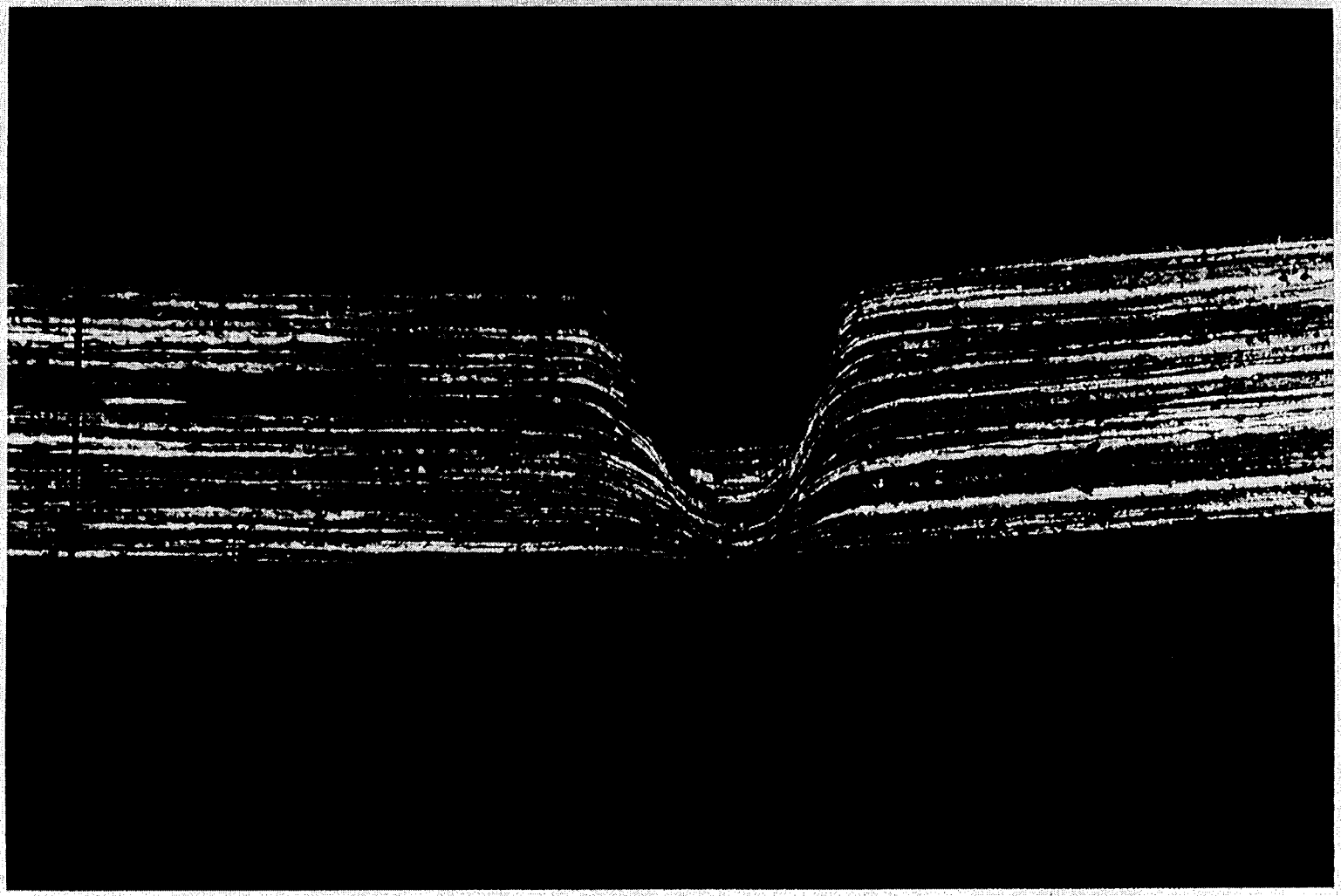
FIG. 2 is a photomicrograph of a cross-section of a portion of a conventional scoreline of the prior art creating by a single scoring operation.

The photomicrograph of FIG. 2 shows a portion of an aluminum container lid having a generally trapezoidal scoreline created by a single step prior art method. As shown, the lid in the region of the scoreline residual metal has an undesirably high level of residual strain. This strain is indicated by the high concentration of alternating light and dark appearing lines.

Figure 3A:
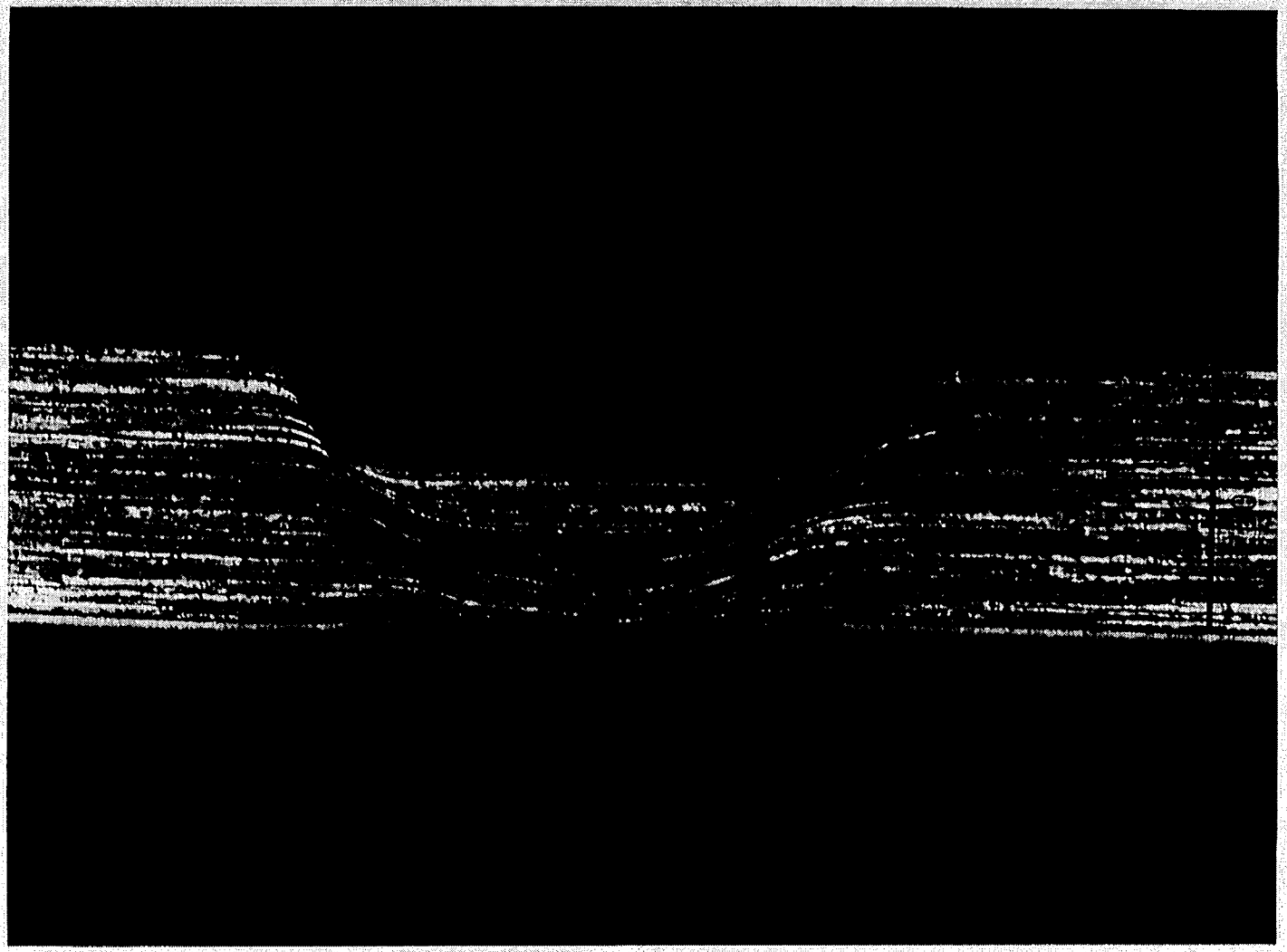
FIGS. 3(*a*) is a photomicrograph of a cross-section of a scoreline subjected to a first scoring operation of the present invention.
Figure 3B:
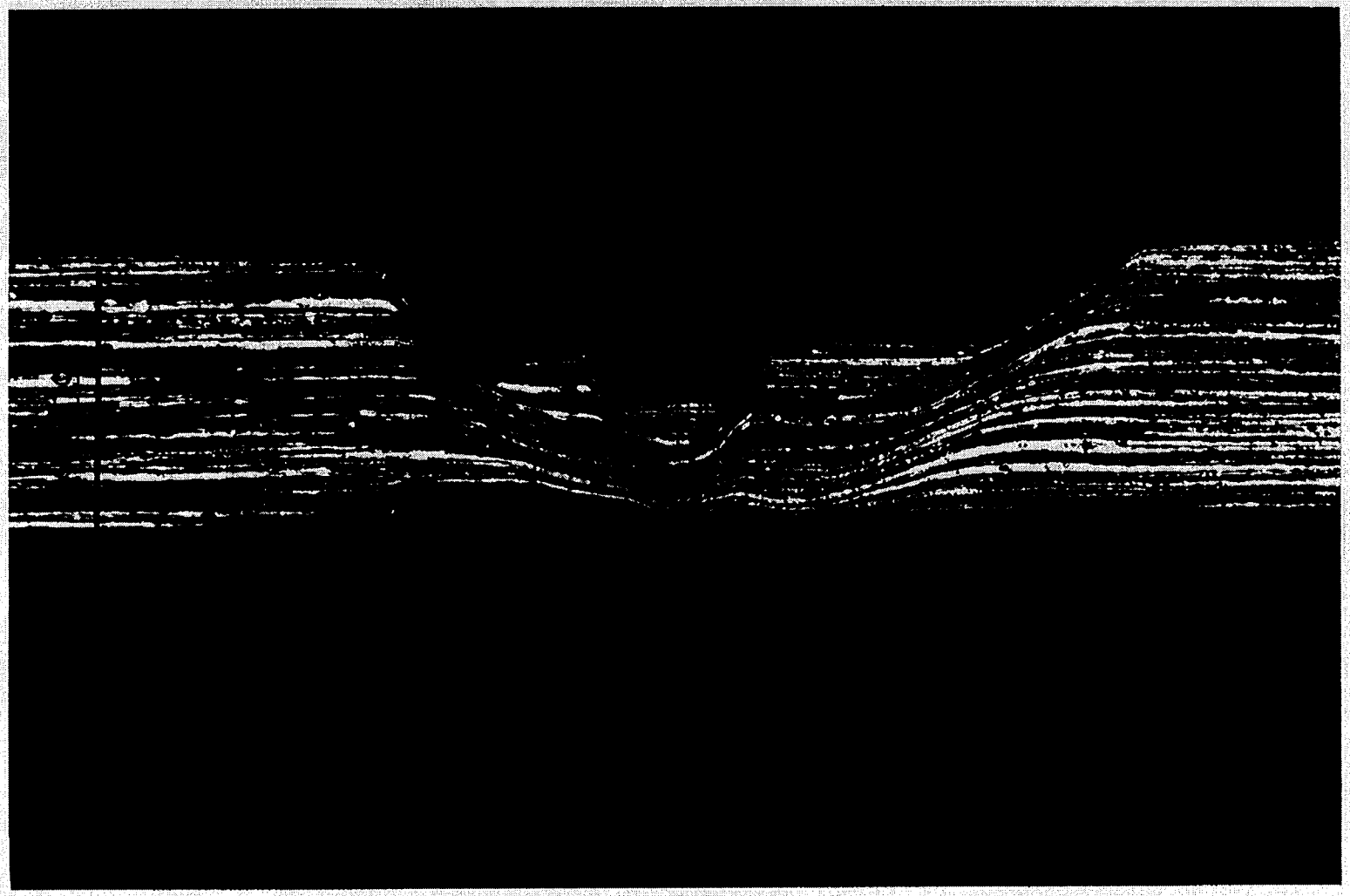

Referring to the photomicrograph of FIG. 3(*a*), there is shown a cross-section of a metal panel which has been subjected to a first scoring operation which has created an indentation of a predetermined depth and width. This scoreline has a base and a pair of generally straight lateral sidewalls which are oriented angularly upwardly and outwardly.

In the photomicrograph of FIG. 3(*b*), a first scoring profile was employed and the second scoring stage of the present invention has been employed to establish a narrower scoreline within the first scoreline.

Figure 4:
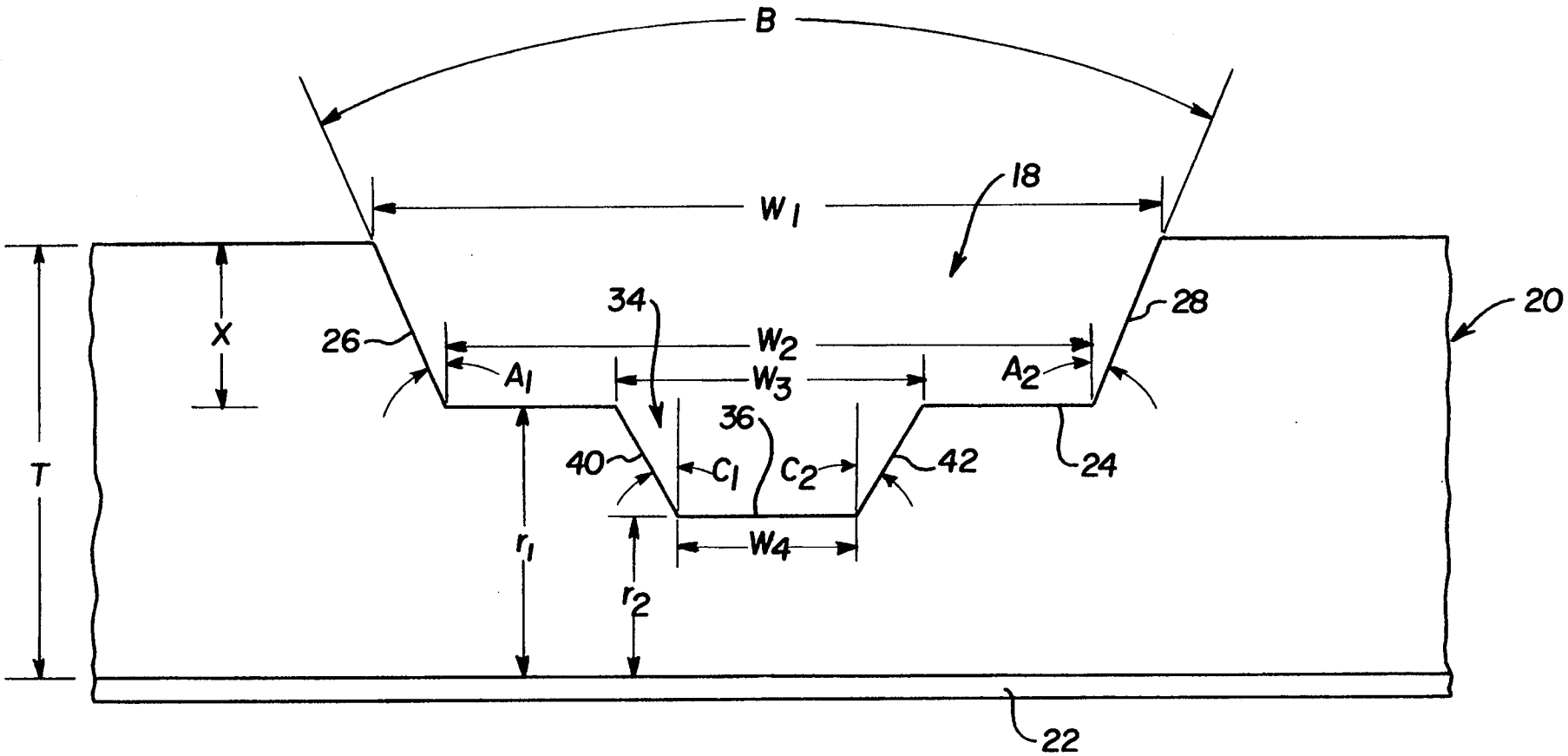
FIG. 4 is a cross-sectional illustration of the scoreline of FIG. 3(*b*).

Examples of the presently contemplated best mode of practicing the invention will be considered with reference to FIG. 4.

Underlying the metal panel 20 is a layer of an organic coating 22 which is secured to the undersurface thereof. During scoring a conventional generally planar surface of an underlying anvil may support the metal panel 20.

In the form shown, the initial scoring step will produce a scoreline 18 of the general configuration shown in FIG. 3(*a*). It has a base 24 which may have a width $W_2$ of about 0.010 to 0.035 inch, an upper width $W_1$ and sidewalls 26, 28 having included angles $A_1$, $A_2$ each of about 1 to 45 degrees with respect to the vertical and, preferably, about 20 to 45 degrees. Angles $A_1$ and $A_2$ are preferably, but not necessarily, equal. If they are equal, $A_1$ and $A_2$ each equal ½ of angle B. Immediately underlying the scoreline base 24 of the first scoreline is a region of generally undeformed metal, as is apparent in FIG. 3(*a*), with the base generally coinciding with base 24 of the indentation.

In conventional methods of manufacturing of easy open end container lids in effecting the balance between integrity of the container lid and the desired level of ease of opening, it is generally conventional to retain a certain minimum residual amount of metal material in the scoreline. The present invention permits employing a lesser minimum residual aluminum thickness in the scoreline while equaling or enhancing ease of opening characteristics.

As is shown in FIGS. 3(*b*) and 4, a second scoreline 34 is established within the base 24 of the first scoreline 18, subsequent to the formation of the first scoreline 18. This scoreline 34 has a base 36 of width $W_4$ which is of lesser width than the width $W_2$ of base 24 of the first scoreline 18. A preferred second scoreline base 34 will have a width about 0.0015 to 0.0035 inch which is preferably about 10 to 35 percent of the width $W_2$ of base 24 of FIG. 4. The second scoreline 34 also has a pair of lateral upwardly diverging sidewalls 40, 42 which in the preferred form included angles $C_1$, $C_2$ to the vertical with each being of about 1 to 45 degrees and preferably about 20–45 degrees. The metal panel may have a thickness T of about 0.007 to 0.015 inch and preferably about 0.008 to 0.012 inch. The residual metal $r_1$ underlying the first scoreline 18 may be about 0.006 to 0.008 inch and residual metal $r_2$ underlying the second scoreline 34 may be about 0.0035 to 0.005 inch. In the preferred practice of the invention a plane containing sidewall 26 will not intersect a plane containing sidewall 40. Similarly, a plane containing sidewall 28 will not intersect a plane containing sidewall 42.

In the preferred embodiment, the second scoring operation has redistributed the region of strain underlying the scoreline established by the first scoreline so as to redistribute the strain away from potential fracture sites into the generally triangular undeformed region.

The present invention may be employed effectively on ends made out of high strength aluminum alloys such as the 5 xxx alloys and, more specifically, 5182 and 5042, for example, or steel or polymer aluminum laminates, for example. The limited formability of such materials has enhanced the hereinbefore described problems prior to the system of the present invention being created.

It is part of the present invention to effect progressive scoring which may involve more than two scoring stages to achieve a desired depth of score. Such scoring will have each successive scoring action employing a tool having an indenter face of lesser width than the scoring tools which were used in establishing the scoreline of the prior stage and scoring being effected within the base of the next preceding scoreline.

The present invention is compatible with, but does not require, the use of anti-fracture scoring which generally refers to scorelines created simultaneously with the primary scoreline at a position spaced laterally therefrom and generally of a lesser depth. Such a scoreline is shown in U.S. Pat. No. 3,954,075 which is owned by the assignee of the present application. Such scorelines serve to create a compressive force between the anti-fracture scoreline or scorelines and the principal scoreline.

The apparatus employed in practicing the present invention may include a conventional press of the type employed currently in manufacturing easy open container lids such as can ends made of aluminum, for example. The corresponding conventional container lid handling equipment may also be employed. In general, in such presses scoring dies are provided for effecting various stages of manufacture and conveying means are provided to transfer sequentially the container lids from one station to the next. In the present invention, such an approach may be employed or, in the alternative, the forming or scoring tools may be indexed so as to provide for multiple stages of scoring with the container wall being positioned at a fixed location. It will be appreciated that the method and tooling of the invention may be employed with any desired system or equipment.

In the practice of the present invention a first scoring tool will preferably create the first scoreline 18 of the type shown in FIG. 4 and a second scoring tool will create the second scoreline 34 within scoreline 18 as is shown in FIG. 4 Additional subsequent scoring stages may be employed if desired If such additional scoring operations are employed, the geometry of the second scoreline may be altered, if desired.

Figure 5:
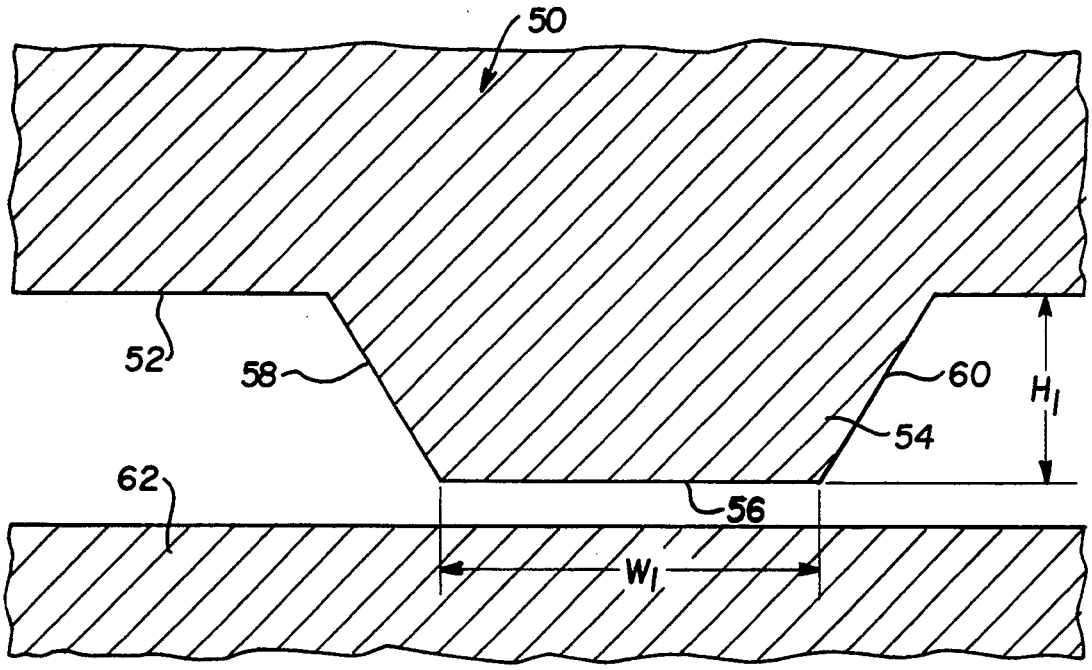
FIG. 5 is a fragmentary cross-sectional illustration of a portion of a scoring tool which may be employed in a first scoring operation of the present invention.

Referring to FIG. 5, a scoring tool for use in creating the first scoreline 18 is shown. The scoring tool has a body portion 50 terminating in a lower surface 52 from which the indenter portion 54 projects downwardly. The indenter portion has an indenter surface 56 and a pair of lateral generally upwardly and outwardly extending sidewalls 58, 60, respectively, an angle with the vertical generally equal to angles $A_1$ and $A_2$. The height of the indenter portion is identified as $H_1$ in FIG. 4. It will be appreciated that by supporting the container lid on a suitable anvil 62 which preferably has a planar upper surface and applying a compressive force to the upper surface of the container lid by the first scoring tool of FIG. 5 with the indenter surface 56 in contact therewith compressively induced flow of metal to create the profile of the first score of FIG. 4 will result.

Referring to FIGS. 3(*b*) and 6, the second scoring tool has a body 70 with a lower surface 72 and a projecting indenter portion which consists of an indenter face 74 which has a width which is less than the width of face 56, a pair of laterally upwardly and outwardly projecting sidewalls 78, 80 which preferably have an angle to the vertical generally equal to angles $C_1$, $C_2$ (FIG. 4). The indenter face 74 preferably has a width which is about 10 to 35% of the width of the first indenter tool face 56. An underlying planar surfaced anvil 82 is employed to support the lid during scoring.

Figure 6:
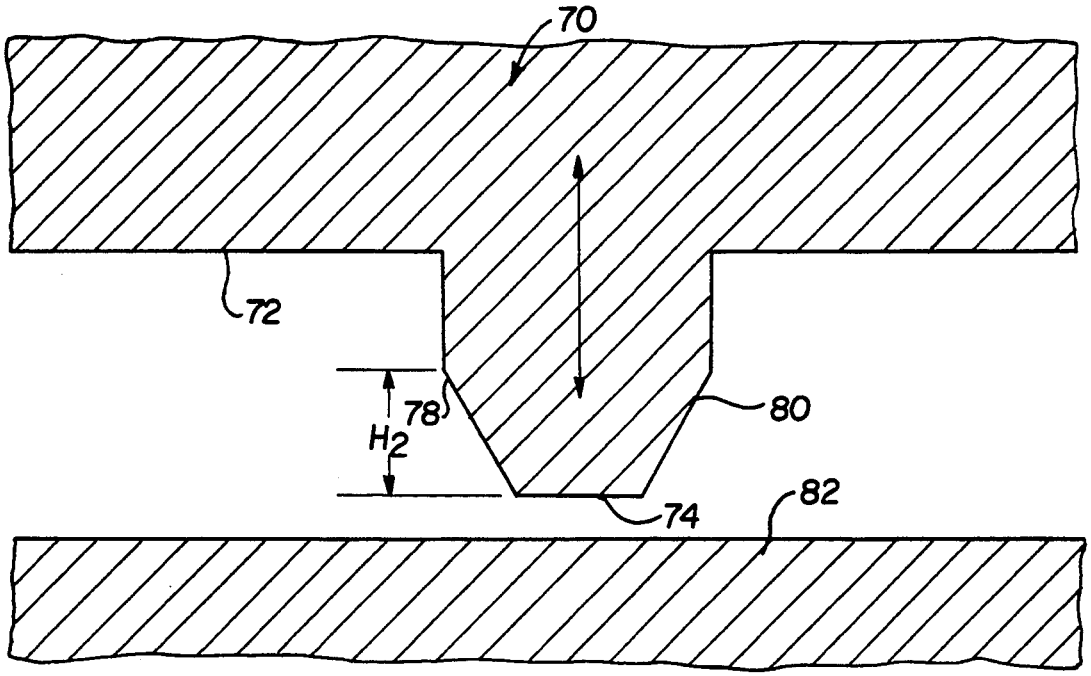
FIG. 6 is a partial cross-sectional illustration of a tool which may be employed in a second scoring operation of the present invention.

It will be appreciated that while the apparatus of the present invention has been disclosed as having two scoring tools as shown in FIGS. 5 and 6, additional scoring tools may be employed with each successive tool having a narrower indenter face than the next preceding one. If more than two stages of scoring are to be employed, the second stage need not make the degree of indentation as the illustrated second stage which is designed to be the final stage of scoring.

The indenter portion of the second tool as shown in FIG. 6 has an operative height $H_2$.

It will be appreciated that the container lid made by the process of this invention will be characterized by reduced residual strain as compared with a container lid scored to the same maximum depth made by a single scoring operation of the prior art. These differences are apparent from FIGS. 2 and 3(*b*).

EXAMPLE

In order to illustrate a preferred practice of the present invention an example will be presented.

An aluminum food container lid having a full panel removable scored section is made of alloy 5042 in H19 temper. The lid has an overall thickness of 0.0090 inch. With reference to FIG. 4, the first scoring operation produces a scoreline of base width of 0.012 inches with angle $A_1$ and $A_2$ each being 30 degrees. The residual metal in the scoreline is 0.0075 inch.

The second scoreline is formed within the first scoreline and has a width at its base of 0.0020 inch with $C_1$ and $C_2$ each being 30 degrees. The residual metal underlying the second scoreline 0.0045 inch.

The strain resulting from the second scoring operation will be localized within the unstrained region which existed within the first scoreline residual after the first scoring operation.

It will be appreciated from the foregoing example, that the sequential scoring technique of the present system eliminates a number of the problems which have existed in the conventional manufacture of scored metal panels including container walls. The multi-stage system of the present invention resists undesired damage to protective coatings and, in fact, permits the possible use of alternate materials for such coatings as the coatings may be of reduced strength as compared with conventional coatings used today. In addition, this invention enhances the strength and performance characteristics of such container lids through resistance to corrosion and provides greater strength due to the reduction or elimination of the undesired presence of shear bands which created problems as a result of localized regions of strain.

Whereas particular embodiments of the invention have been described herein for purposes of illustration, it will be evident to those skilled in the art that numerous variations of the details may be made without departing from the invention as defined in the appended claims.

We claim:

1. A multistage method of scoring a metal panel of a container lid component to create a scoreline comprising forming in said metal panel a first scoreline having a generally straight base and a pair of generally straight generally upwardly diverging first sidewalls, forming within said first scoreline a second scoreline by indenting a portion of said first scoreline base, forming said second scoreline with a second base and a pair of second lateral generally straight generally upwardly diverging sidewalls, forming said second scoreline with the angle between each said second lateral wall and the vertical being about 20 to 45 degrees, simultaneously with the forming of said first scoreline establishing an unstrained region adjacent to said first scoreline by providing said straight base with a predetermined width, and simultaneously with the forming of said second scoreline establishing metal flow which at least partially redirects the material into said unstrained region.

2. The method of claim 1 including employing said method on aluminum can ends which have a partially or totally removable panel defined by said scoreline.

3. The method of claim 2 including subsequent to forming said second scoreline forming at least one additional scoreline within said second scoreline.

4. The method of claim 1 including employing said method on a container lid wall made of a 5xxx aluminum alloy, and forming said first and second scorelines with said first scoreline having a base that is wider than said second scoreline base.

5. The method of claim 4 including forming said first scoreline with said base having a width of about 0.010 to 0.035 inch.

6. The method of claim 5 including forming said first scoreline with included angles between said first sidewalls and the vertical each being of about 20 to 45 degrees.

7. The method of claim 6 including forming said second scoreline with said second scoreline base having a width of about 0.0015 to 0.0035 inch.

8. The method of claim 7 including employing a first indenter tool to form said first scoreline, and employing a second indenter score tool to form said second scoreline.

9. The method of claim 2 including employing as said metal panel an aluminum can end having an organic coating on the underside thereof, and establishing said first and second scorelines with said first and second indenter tools without fracturing said coating.

10. The method of claim 3 including forming each said additional scoreline having a base of lesser width than the next preceding scoreline.

11. The method of claim 4 including forming said first scoreline while retaining a portion of substantially undeformed metal under said first scoreline, and during formation of said second scoreline establishing metal flow from a region of metal strain underlying said scoreline into said undeformed region.

12. The method of claim 11 including supporting the undersurface of said can end on a substantially planar anvil during said scoring operations.

13. Apparatus for scoring a metal container lid wall comprising press means for supporting said container wall and moving scoring tools into scoring relationship with said container walls, first scoring tool means secured to said press means for establishing a first scoreline within said container wall, second scoring tool means for establishing a second scoreline within said first scoreline, said first scoring tool means having an indenter face width of about 0.010 to 0.035 inch, said first tool means having a pair of generally straight lateral faces disposed on opposite sides of said indenter face and each having an included angle with respect to the vertical of about 20° to 45° degrees, said second scoring tool means having an indenter face width of about 0.0015 to 0.0035 inch, and said second scoring tool means having a pair of generally straight generally upwardly and outwardly oriented lateral surfaces disposed on opposite sides of said indenter tool face at an angle with the vertical of about 20° to 45° degrees.

14. The apparatus of claim 13 including said press means having means for forming said first scoreline before said second scoreline.

15. The apparatus of claim 13 including at least one additional scoring tool means secured to said press means for establishing at least one additional scoreline within said second scoreline.

* * * * *